United States Patent [19]

Andis et al.

[11] Patent Number: 4,659,907

[45] Date of Patent: Apr. 21, 1987

[54] WALL MOUNTED DEVICE WITH HAND-HELD HAIR DRYER

[75] Inventors: Matthew L. Andis; Richard L. Urbush; Thomas C. Maddocks, all of Racine, Wis.

[73] Assignee: Andis Company, Racine, Wis.

[21] Appl. No.: 477,510

[22] Filed: Mar. 21, 1983

[51] Int. Cl.[4] ..... A45D 20/00; H01H 3/16

[52] U.S. Cl. ..... 219/370; 219/242; 219/364; 219/379; 248/674

[58] Field of Search ..... 34/239, 96, 97; 248/674, 313, 316 B, 314, 201; 219/364, 369–371, 379, 242, 247, 518; 200/85 R, 61.58 R; 179/159

[56] References Cited

U.S. PATENT DOCUMENTS

| | | | |
|---|---|---|---|
| 1,100,480 | 6/1914 | Haralson et al. | 200/85 R |
| 1,455,034 | 5/1923 | Small | 219/364 |
| 1,554,347 | 9/1925 | Hansen et al. | 200/85 R |
| 1,681,291 | 8/1928 | Glass | 219/242 |
| 2,482,540 | 9/1949 | Furnas et al. | 200/85 R |
| 2,586,910 | 2/1952 | Bolle | 200/85 R |
| 3,911,934 | 10/1975 | Helbing | 34/96 |
| 3,964,708 | 6/1976 | Reeves | 219/242 |
| 4,195,416 | 4/1980 | Hall | 34/97 |
| 4,219,178 | 8/1980 | Assion | 248/314 |
| 4,225,106 | 9/1980 | Eplan | 219/370 |
| 4,464,582 | 8/1984 | Aragaki et al. | 34/96 |
| 4,493,975 | 1/1985 | Yamamoto | 219/364 |

FOREIGN PATENT DOCUMENTS

| | | | |
|---|---|---|---|
| 63670 | 11/1982 | European Pat. Off. | 219/379 |
| 2395677 | 2/1979 | France | 219/379 |
| 2504366 | 10/1982 | France | 219/370 |
| 47-24320 | 7/1972 | Japan | 34/96 |
| 296541 | 9/1928 | United Kingdom . | |
| 397230 | 8/1933 | United Kingdom . | |
| 1391397 | 4/1975 | United Kingdom . | |
| 1590133 | 5/1981 | United Kingdom . | |
| 1604307 | 12/1981 | United Kingdom . | |

OTHER PUBLICATIONS

"Merchandising", p. 96, 1/83.

*Primary Examiner*—A. D. Pellinen
*Assistant Examiner*—Geoffrey S. Evans
*Attorney, Agent, or Firm*—Michael, Best & Friedrich

[57] ABSTRACT

A device including a hand-held hair dryer and a hair dryer mount adapted to be attached to a planar support. The mount includes a catch for supporting and releasably preventing detachment of the hair dryer from the mount. In one embodiment, the hand-held hair dryer includes a first end and a second end with an indentation, and the catch includes a lower lever for receiving the first end of the hair dryer and an upper lever for releasably retaining the first end in the lower lever. The upper lever includes a tab receivable in the indentation. The mount also includes a switch for energizing and de-energizing the hair dryer and a switch actuator for operably connecting the upper lever to the switch. The mount also includes a bar for preventing movement of the upper lever when the lower lever is not engaged by the first end of the hair dryer, and a tab located adjacent the hair dryer on the upper lever for preventing energizing of the hair dryer when the hair dryer is received by the catch.

21 Claims, 5 Drawing Figures

WALL MOUNTED DEVICE WITH HAND-HELD HAIR DRYER

BACKGROUND AND SUMMARY OF THE INVENTION

This invention relates to wall mounted devices including a hand-held electric hair dryer and means for mounting the hair dryer on a wall.

This invention provides a device comprising a hand-held hair dryer, and hair dryer mounting means adapted to be atttached to a planar support. The mounting means includes catch means for supporting and releasably preventing detachment of the hair dryer from the mounting means.

In one embodiment, the hand-held hair dryer includes a first end and a second end with an indentation, and the catch means includes means for receiving the first end of the hair dryer and lever means for releasably retaining the first end in the receiving means. The lever means includes a tab receivable in the indentation. The embodiment also includes switch means for energizing and de-energizing the hair dryer and means for operably connecting the lever means to the switch means for energizing the hair dryer in response to movement of the lever means and for de-energizing the hair dryer in response to reverse movement of the lever means. The embodiment also includes means for preventing movement of the lever means when the end receiving means is not engaged by the first end of the hair dryer, and means for preventing energizing of the hair dryer when the hair dryer is received by the catch means.

The preventing means comprises a tab which prevents movement of the lever means when the hair dryer is received by the catch means and which is located adjacent the hair dryer on the lever means.

One of the principal features of this invention is the provision of a wall mounted device with a hand-held hair dryer which provides for safe storage of the hair dryer when not in use.

Other features and advantages of embodiments of the invention will become apparent upon reviewing the following drawings, the detailed description and the appended claims.

Figure 5:
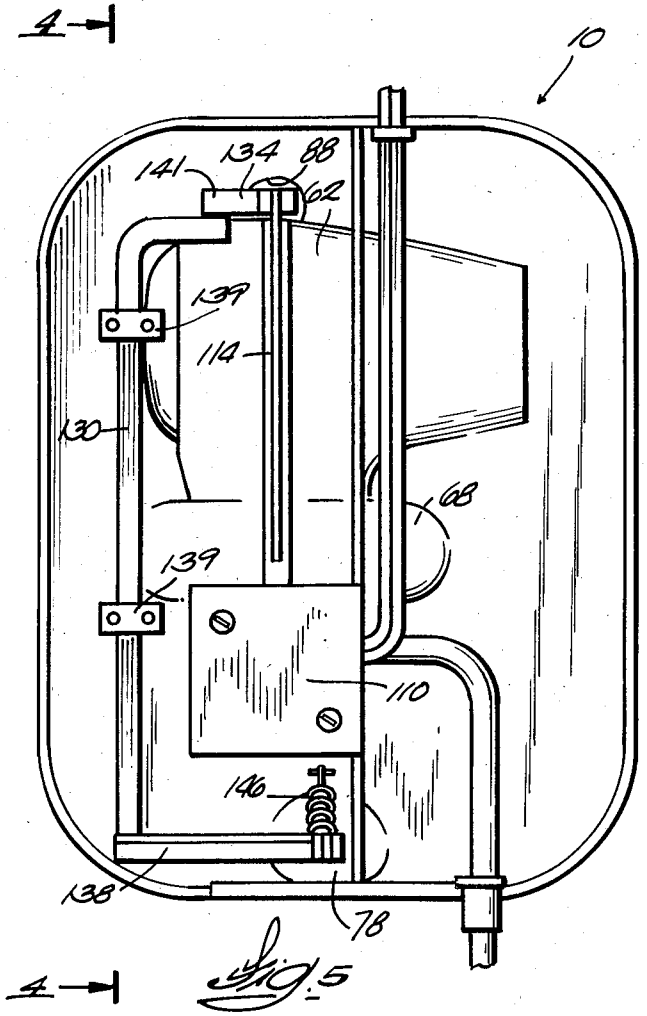
FIG. 5 is a rear view of the wall mounted hair dryer shown in FIG. 1 with the base removed.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

DESCRIPTION OF THE PREFERRED EMBODIMENT

Figure 1:
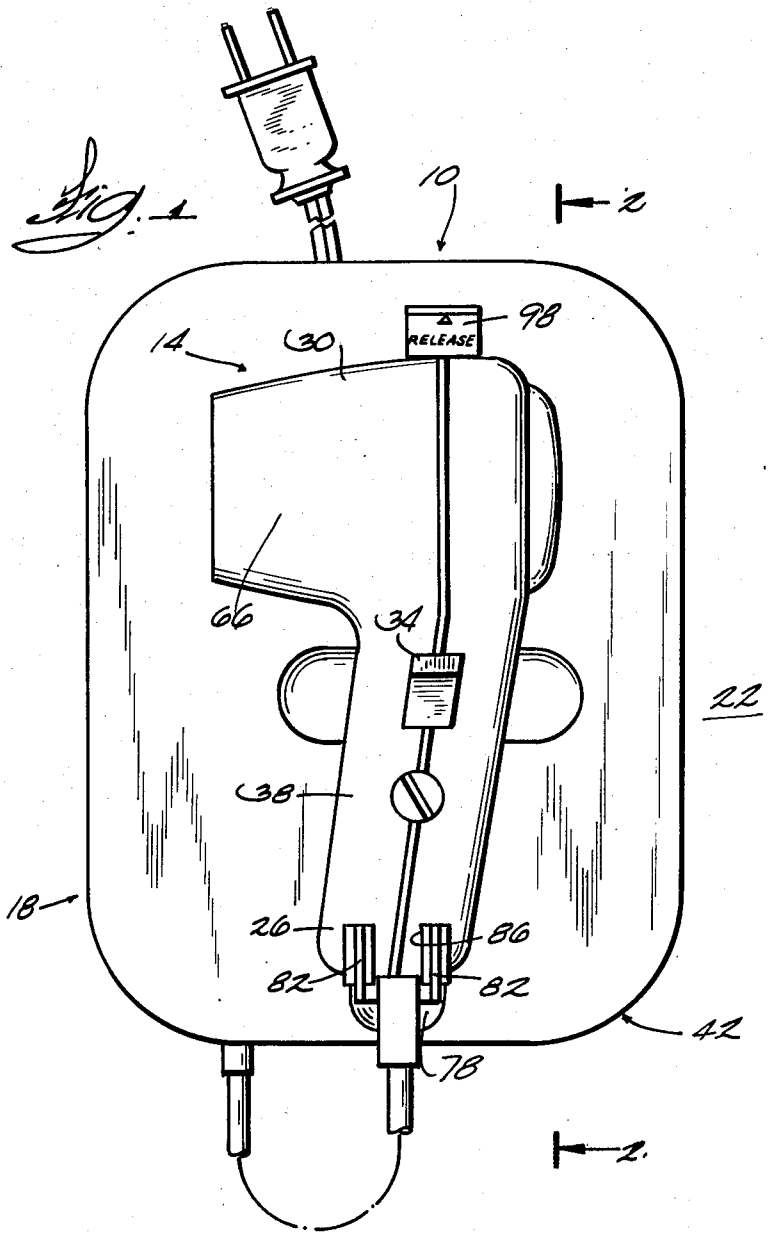
FIG. 1 is a plain view of a device which embodies various of the features of the invention.

As illustrated in FIG. 1, this invention provides a device or wall mounted hair dryer 10 comprising a hand-held hair dryer 14 and hair dryer mounting means 18 adapted to be mounted to a planar support 22, such as a wall. The mounting means provides a convenient, safe location for storing the hair dryer 14 when not in operation.

The hair dryer 14 is a conventional pistol type and includes a first or lower end 26 and a second or upper end 30. The hair dryer 14 is electrically operated and includes a waterproof heat and speed adjustment switch 34 on the handle 38 of the hair dryer 14. In other embodiments, the switch 34 can also energize and de-energize the hair dryer 14.

Figure 3:
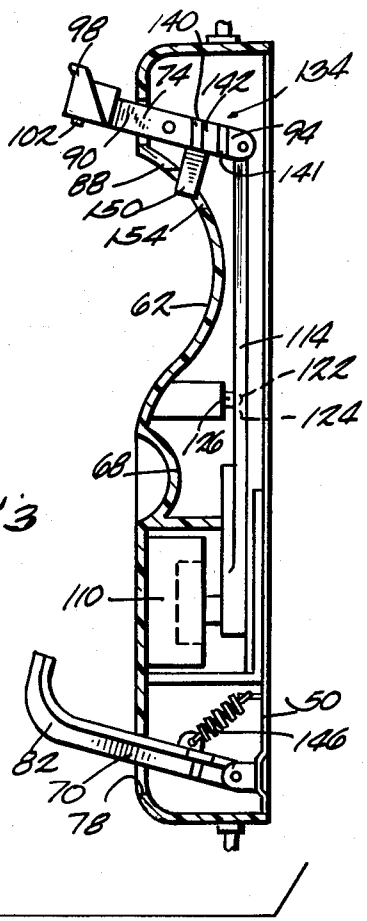
FIG. 3 is a cross sectional view of the device shown in FIG. 2 with the hand-held hair dryer removed from the hair dryer mounting means.
Figure 2:
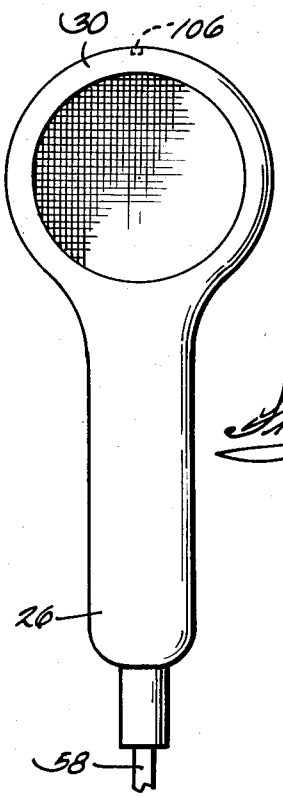
FIG. 2 is a cross sectional view of the device taken along the line 2—2 in FIG. 1.
Figure 2:
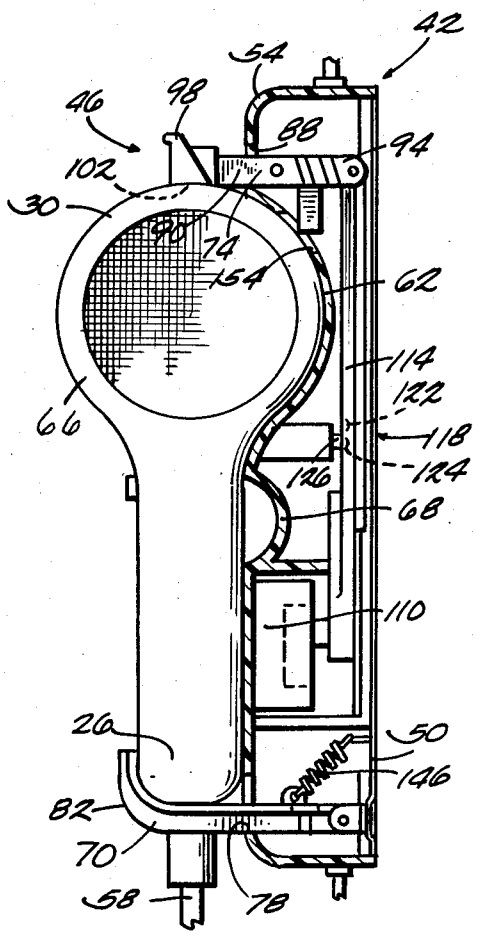

The mounting means 18 includes a housing 42 and catch means 46 for supporting and releasably preventing detachment of the hair dryer 14 from the mounting means 18. As best shown in FIGS. 2 and 3, the housing 42 includes a base 50 adapted to be attached to the wall 22 and a base cover 54 releasably attachable to the base 50. The catch means 46 and electrical wiring for the wall mounted hair dryer 10 are enclosed within the mounting means housing 42. A cord 58 extends from within the housing 42 to the hand-held hair dryer 14 to supply electrical current to the hair dryer 14. The base cover 54 includes an indentation 62 for receiving a heater portion 66 of the hair dryer 14 and an indentation 68 for facilitating grasping of the handle 38 of the hair dryer 14.

The catch means 46 comprises means 70 for receiving or supporting the lower end 26 of the hair dryer 14 and means 74 for releasably retaining the lower end 26 in the receiving means 70, i.e., for preventing detachment of the hair dryer from the supporting means. As illustrated in FIGS. 2 and 3, the receiving means 70 comprises a lower lever extending through an opening 78 in the base cover 54 and pivotally attached at one end to the lower portion of the base 50. A free end of the lower lever 70 includes an upwardly curved portion 82 which receives the lower end 26 of the hair dryer 14 and prevents horizontal movement of the dryer 14 along the lower lever 70. As illustrated in FIG. 1, the curved portion 82 of the lower lever 70 includes a slot 86 for receiving the cord 58 extending from the lower end 26 of the hair dryer 14 to within the housing 42.

The means 74 for releasably retaining the lower end 26 of the hair dryer 14 in the receiving means 70 comprises an upper lever. The upper lever 74 extends through an opening 88 in the base cover 54 and is pivotally attached near its midpoint to the base cover 54 adjacent the upper end 30 of the hair dryer 14. The upper lever 74 includes a first end 94 and a second end 90 over the upper end 30 of the hair dryer 14. The second end 90 includes a release button 98 with a downwardly extending tab 102. The tab 102 is receivable in an indentation 106 in the upper end 30 of the hair dryer 14 after the lower end 26 of the hair dryer 14 is placed in the receiving means 70.

The mounting means 18 further includes switch means 110 mounted on the inside of the base cover 54 for engergizing and de-energizing the hair dryer 14. The mounting means 18 also includes means 114 for operably connecting the upper lever 74 to the switch means 110 for energizing the hair dryer 14 in response to movement of the upper lever 74 and for de-energizing the hair dryer 14 in response to reverse movement of the upper lever 74. This means 114 comprises a switch actuator which is pivotally connected to the first end 94 of the upper level 74 and to the switch means 110 and which moves downwardly when the release button 98 is moved upwardly. The downward movement of the switch actuator 114 thus operates the switch means 110 to energize the hair dryer 14. Likewise, when the switch actuator 114 is moved upwardly by the downward movement of the release button 98, the switch actuator 114 operates the switch means 110 to de-energize the hair dryer 14.

The mounting means 18 also includes detent means 118 for providing the upper lever with a positive switching "feel" or action. The detent means 118 comprises a pair of vertically spaced sockets 122 and 124 in the switch actuator 114 adjacent a spring-loaded ball 126 mounted on the base cover 54. The ball 126 is received in first one socket then another as the switch actuator 114 is moved by the upper lever 74.

Figure 4:
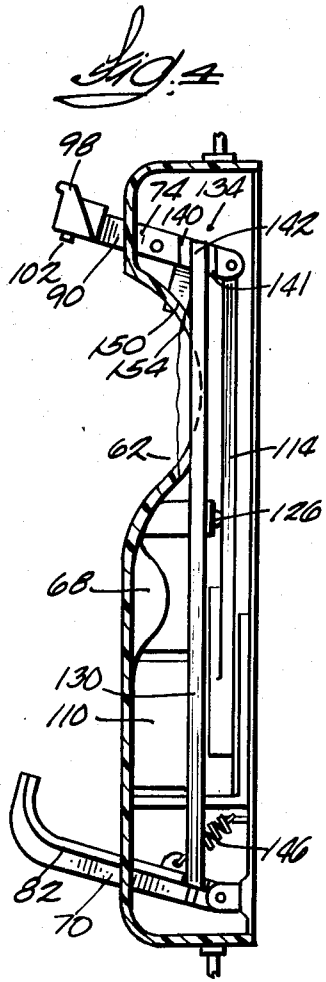
FIG. 4 is a cross sectional view of the wall mounted hair dryer taken along the line 4—4 in FIG. 5.

As best shown in FIGS. 4 and 5, the hair dryer mounting means 18 further includes means 130 for preventing movement of the upper level 74 when the end receiving means 70 is not engaged by the lower end 26 of the hair dryer 14 or held in a lowered position by some other means. This preventing means 130 comprises a bar which extends between a perpendicular extension 134 on the side of the upper lever 74 and a perpendicular extension 138 on the side of the lower lever 70. Means 139 holds the bar 130 between the extensions 134 and 138 and permits vertical movement of the bar 130. The perpendicular extensions 134 and 138 are provided so the bar 130 is adjacent the base cover 54 and away from the indentation 62. When the lower lever 70 pivots upwardly moving the bar 130 upwardly, the bar 130 engages a slot 142 formed between two spaced apart parallel arms 140 and 141 of the perpendicular extension 134 on the side of the upper lever 74. The slot 142 is aligned with the bar 130 when the release button 98 on the upper lever 74 is in the upward or release position so that the upper lever 74 cannot pivot when the bar 130 is received in the slot 142.

To insure the bar 130 is engaged in the slot 142 when the hair dryer 14 is removed from the mounting means 18, the lower lever 70 includes means 146 for biasing the lower lever 70 upwardly, such as a spring extending between the lower lever 70 and the base 50. Unless removed from the slot 142 in the upper lever 74, the bar 130 prohibits the upper lever 74 from pivoting and the release button 98 from moving downwardly thereby de-energizing the hair dryer 14, as illustrated in FIG. 4.

As best shown in FIGS. 2 and 3, the hair dryer mounting means 18 also includes means for preventing energizing of the hair dryer 14 when the hair dryer is received in the catch means 46. This means comprises a tab 150 extending perpendicularly from the lower side of the upper lever 74 adjacent the upper end 30 of the hair dryer 14. The tab 150 extends through an opening 154 in the receiving indentation 62. The tab 150 is movable with the upper lever 74 towards the hair dryer 14 when the release button 98 moves upwardly. As a result, the upward movement of the release button 98 and the pivotal movement of the upper lever 74 causes the tab 150 to push the hair dryer 14 outwardly. Since the hair dryer 14 thus cannot remain in the mounting means 18 when the release button 98 is moved upwardly, the tab 150 prevents the energizing of the hair dryer 14 while the hair dryer 14 is mounted on the mounting means 18. The tab 150 also serves to move the release button 98 downwardly to engage the tab 102 in the receiving indentation 106 in the upper end 30 of the hair dryer 14 when the hair dryer 14 is placed in the indentation 62 in the base cover 54.

Various of the features of the invention are set forth in the following claims.

We claim:

1. A device comprising a handheld hair dryer having spaced first and second portions, and hair dryer mounting means adapted to be attached to a support, said mounting means including means for supporting and releasably preventing detachment of said hair dryer from said mounting means and including means for receiving said first portion of said hair dryer and manually releasable means engageable with said second portion for retaining said hair dryer in said receiving means and for permitting withdrawal of said hair dryer from said receiving means when manually actuated.

2. A device in accordance with claim 1 wherein said mounting means further includes switch means for energizing and de-energizing said hair dryer, and means operably connecting said switch means to said means for releasably retaining said first portion in said receiving means for de-energizing said hair dryer in response to mounting of said hair dryer on said mounting means.

3. A device in accordance with claim 1 wherein said means for releasably retaining said first portion in said receiving means comprises a lever and wherein said mounting means further includes switch means for energizing and de-energizing said hair dryer and means operably connecting said lever to said switch means for energizing said hair dryer in response to movement of said lever and for de-energizing said hair dryer in response to reverse movement of said lever.

4. A device in accordance with claim 3 and wherein said second portion includes an indentation and wherein said lever includes a tab receivable in said indentation.

5. A device in accordance with claim 1 wherein said mounting means further includes a housing including an indentation for receiving said hair dryer.

6. A device in accordance with claim 1 and further including means preventing energizing of said hair dryer when said hair dryer is received by said means for supporting and releasably preventing detachment of said hair dryer.

7. A device in accordance with claim 6 wherein said manually releasable means includes a movably mounted lever, and wherein said preventing means comprises a tab which prevents movement of said lever when said hair dryer is received by said means for supporting and releasably preventing detachment of said hair dryer and which is located on said lever adjacent said hair dryer.

8. A device comprising a hand-held hair dryer including a first portion, and hair dryer mounting means adapted to be attached to a support, said mounting means including means for supporting and releasably preventing detachment of said hair dryer from said mounting means and including means for receiving said first portion of said hair dryer, and means for releasably retaining said first portion in said receiving means, said means for releasably retaining said first portion in said receiving means comprising a movable mounted member engagable with said second portion, switch means on said mounting means for energizing and de-energizing said hair dryer, means for operably connecting said member to said switch means for energizing said hair dryer in response to movement in one direction of said member and for deenergizing said hair dryer in response to reverse movement of said member, and means on said means for releasably retaining said first hair dryer portion for preventing reverse movement of said member when said receiving means is not engaged by said first portion of said hair dryer.

9. A device comprising a hand-held hair dryer including spaced first and second portions, and hair dryer mounting means adapted to be attached to a support, said mounting means including means for supporting and releasably preventing detachment of said hair dryer from said mounting means and including means for receiving said first portion of said hair dryer and means including a manually movable member engageable with said second portion for releasably retaining said first portion in said receiving means and for permitting withdrawal of said hair dryer from said receiving means when manually actuated.

10. A device comprising a hand-held hair dryer including a first end and a second end with an indentation, and hair dryer mounting means adapted to be attached to a planar support, said mounting means including catch means for supporting and releasably preventing detachment of said hair dryer from said mounting means, said catch means including means for receiving said first end of said hair dryer and lever means for releasably retaining said first end in said receiving means and including a tab receivable in said indentation, switch means for energizing and de-energizing said hair dryer, means for operably connecting said lever means to said switch means for energizing said hair dryer in response to movement of said lever means and for de-energizing said hair dryer in response to reverse movement of said lever means, means for preventing movement of said lever means when said end receiving means is not engaged by said first end of said hair dryer, and means for preventing energizing of said hair dryer when said hair dryer is received by said catch means, said preventing means comprising a tab which prevents movement of said lever means when said hair dryer is received by said catch means and which is located adjacent said hair dryer on said lever means.

11. A device comprising a hand-held hair dryer, hair dryer mounting means for releasably holding said hair dryer and adapted to be attached to a support, switch means on said mounting means for energizing and de-energizing said hair dryer, means for releasably preventing de-energizing of said hair dryer by said switch means when said hand-held hair dryer is removed from said mounting means, manually accessible means movable relative to an over-ride position for over-riding said means for releasably preventing de-energizing of said hair dryer, and releasable means for maintaining said manually accessible means in the over-ride position.

12. A device comprising a hand-held hair dryer including a first portion and a second portion with an indentation, and hair dryer mounting means adapted to be attached to a support, said mounting means including means for supporting and releasably preventing detachment of said hair dryer from said mounting means including means for receiving said first portion of said hair dryer, and manually movable means including a tab receivable in said indentation for releasably retaining said first portion in said receiving means and for permitting withdrawal of said hair dryer from said receiving means when manually moved.

13. A device comprising a hand-held hair dryer including spaced first and second portions, and hair dryer mounting means adapted to be attached to a support, said mounting means including means for supporting and releasably preventing detachment of said hair dryer from said mounting means and including means for receiving said first portion of said hair dryer, and manually movable means engageable with said second portion for releasably retaining said first portion in said receiving means, and for permitting withdrawal of said hair dryer from said receiving means when manually moved, switch means for energizing and deenergizing said hair dryer, means operably connecting said manually movable means to said switch means for energizing said hair dryer in response to movement in one direction of said manually movable means and for de-energizing said hair dryer in response to reverse movement of said manually movable means, and means for preventing reverse movement of said manually movable means when said receiving means is not engaged by said first portion of said hair dryer.

14. A device comprising a hand-held hair dryer including spaced first and second portions, and hair dryer mounting means adapted to be attached to a support, said mounting means including means for supporting and releasably preventing removal of said hair dryer from said mounting means and including means for receiving said first portion of said hair dryer, and manually movable means engageable with said second portion for releasably retaining said first portion in said receiving means, switch means for energizing and de-energizing said hair dryer, means operably connecting said manually movable means to said switch means for energizing and de-energizing said hair dryer in response to movement of said manually movable means, and means for preventing energizing of said hair dryer when said hair dryer is received by said receiving means, said preventing means comprising a tab located on said manually movable means and engageable with said hair dryer to prevent movement of said manually movable means when said hair dryer is received by said mounting means.

15. A device comprising a hand-held hair dryer including first and second portions, and hair dryer mounting means adapted to be attached to a support, said mounting means including means for supporting and releasably preventing detachment of said hair dryer from said mounting means and including means for receiving said first portion of said hair dryer, and means for releasably retaining said first portion in said receiving means, said means for releasably retaining said first portion in said receiving means comprising a movably mounted lever engageable with said second portion, switch means on said mounting means for energizing and de-energizing said hair dryer, and means for operably connecting said lever to said switch means for energizing said hair dryer in response to movement in one direction of said lever and for deenergizing said hair dryer in response to reverse movement of said lever.

16. A device comprising a hand-held hair dryer, and mounting means for releasably supporting said hair dryer from a support and comprising a base adapted to be fixedly connected to the support, a cover releasably attached to said base, means on said cover for releasably supporting said hair dryer and including manually releasable means engageable with said hair dryer for retaining said hair dryer on said mounting means and for permitting withdrawal of said hair dryer from said mounting means when manually actuated, and an electrical switch mounted on said cover and electrically connected to said hair dryer for controlling electrical energization thereof.

17. A device in accordance with claim 16 wherein said mounting means further includes means operably connecting said switch means to said means for releasably supporting said hair dryer for de-energizing said hair dryer in response to mounting of said hair dryer on said mounting means.

18. A device in accordance with claim 16 wherein said cover includes at least a part of said means for releasably supporting said hair dryer.

19. A device in accordance with claim 16 wherein said base includes at least a part of said means for releasably supporting said hair dryer.

20. A device comprising a hand-held hair dryer, and hair dryer mounting means adapted to be attached to a support, said mounting means including means for supporting said hair dryer, and means for releasably preventing detachment of said hair dryer from said supporting means and including manually releasable means movable relative to said supporting means and engageable with said hair dryer for retaining said hair dryer in said supporting means and for permitting withdrawal of said hair dryer from said supporting means when manually actuated.

21. A device in accordance with claim 20 wherein said mounting means further includes switch means for energizing and de-energizing said hair dryer, and means operably connecting said switch means to said means for releasably retaining said hair dryer in said mounting means for de-energizing said hair dryer in response to mounting of said hair dryer on said mounting means.

* * * * *